US010555061B2

(12) United States Patent
Ding et al.

(10) Patent No.: US 10,555,061 B2
(45) Date of Patent: Feb. 4, 2020

(54) MICROPHONE AND MANUFACTURE THEREOF

(71) Applicants: Semiconductor Manufacturing International (Shanghai) Corporation, Shanghai (CN); Semiconductor Manufacturing International (Beijing) Corporation, Shanghai (CN)

(72) Inventors: Pan Ding, Shanghai (CN); Qiang Wang, Shanghai (CN); Hongjun Yu, Shanghai (CN); Hui Shi, Shanghai (CN)

(73) Assignees: SEMICONDUCTOR MANUFACTURING INTERNATIONAL (SHANGHAI) CORPORATION (CN); SEMICONDUCTOR MANUFACTURING INTERNATIONAL (BEIJING) CORPORATION (CN)

( * ) Notice: Subject to any disclaimer, the term of this patent is extended or adjusted under 35 U.S.C. 154(b) by 0 days.

(21) Appl. No.: 15/934,096

(22) Filed: Mar. 23, 2018

(65) Prior Publication Data

US 2018/0279031 A1 Sep. 27, 2018

(30) Foreign Application Priority Data

Mar. 24, 2017 (CN) ..... 2017 1 0180156

(51) Int. Cl.
*H04R 1/08* (2006.01)
*H04R 23/00* (2006.01)
*H04R 19/04* (2006.01)
*H04R 31/00* (2006.01)

(52) U.S. Cl.
CPC ..... *H04R 1/083* (2013.01); *H04R 19/04* (2013.01); *H04R 23/006* (2013.01); *H04R 31/006* (2013.01)

(58) Field of Classification Search
CPC ..... H04R 2201/003; H04R 19/005; H04R 1/222; B81B 3/00; B81B 3/0018; B81B 2201/003; B81B 2201/0264
See application file for complete search history.

(56) References Cited

U.S. PATENT DOCUMENTS

2009/0200620 A1* 8/2009 Omura ..... B81B 3/0021 257/419
2010/0212432 A1* 8/2010 Kasai ..... H04R 19/005 73/654
2015/0078593 A1* 3/2015 Uchida ..... H04R 19/005 381/191
2017/0359648 A1* 12/2017 Park ..... B81B 3/0021

* cited by examiner

*Primary Examiner* — Sunita Joshi
(74) *Attorney, Agent, or Firm* — Innovation Counsel LLP

(57) ABSTRACT

A microphone and its manufacturing method, relating to semiconductor techniques. The microphone comprises a capacitor comprising of a back plate and a vibration film plate, with the vibration film plate comprising a plurality of holes. The holes in the vibration film plate provide a ventilation route for pressured air in the microphone, and thus reduce the pressure on the vibration film plate which otherwise is susceptible to damaged under high air pressure. This inventive concept improves a microphone's acoustic tolerance.

20 Claims, 8 Drawing Sheets

MICROPHONE AND MANUFACTURE THEREOF

CROSS-REFERENCE TO RELATED APPLICATION

This application claims priority to and benefit of Chinese Patent Application No. 201710180156.6 filed on Mar. 24, 2017, which is incorporated herein by reference in its entirety.

BACKGROUND (a) Field of the Invention

This inventive concept relates generally to semiconductor techniques, and more specifically, to a microphone and its manufacturing method.

(b) Description of the Related Art

Microphone basically is a capacitance-based sound transmission device, it measures the pressure a sound wave generated when traveling through air or liquid and converts it into an electric signal. A basic Micro Electro Mechanical System (MEMS) microphone comprises a solid vibration film plate and a back plate. Incoming sound wave causes deformation on the vibration film plate, which in turn causes a change of capacitance of a flat panel capacitor.

To ensure effective reception of a sound wave, the vibration film plate need to be made very thin, which, however, makes it susceptible to damage. Sound waves with a large amplitude may fracture the vibration film as a result of large-amplitude oscillations of the film. With ever increasing demand for the acoustic devices that work in a wide power range, a microphone with high acoustic tolerance as demonstrated in Air Pressure Test (APT), a test that evaluates the acoustic tolerance of a microphone, is increasingly desirable.

SUMMARY

The inventor of this inventive concept investigated the issues in conventional techniques and proposed an innovative solution that remedies at least some issues of the conventional methods.

This inventive concept first presents a microphone, comprising:

a capacitor comprising of a back plate and a vibration film plate, with the vibration film plate comprising one or more holes.

Additionally, in the aforementioned microphone, the diameters of the holes may be less than or equal to 18 μm.

Additionally, in the aforementioned microphone, the holes in the vibration film plate may be radially distributed from the center to the periphery of the vibration film plate or symmetrically distributed with respect to the center of the vibration film plate, and have a pattern of a concentric ring or a matrix, and the number of holes may be in a range of 1 to 500.

Additionally, in the aforementioned microphone, the vibration film plate may be a polycrystalline silicon film.

This inventive concept further presents a microphone manufacturing method, comprising:

forming an insulation layer;

forming a vibration film plate on the insulation layer;

forming a plurality of holes in the vibration film plate;

forming a sacrificial layer on the vibration film plate;

forming a back plate on the sacrificial layer;

forming a support layer on the back plate; and removing the insulation layer and the sacrificial layer through an etching process.

Additionally, in the aforementioned method, forming a plurality of holes in the vibration film plate may comprise:

forming a patterned mask on the vibration film plate, with the sizes and the locations of the plurality of holes being determined by the patterned mask; and conducting an etching process on the vibration film plate with respect to the patterned mask to form the plurality of holes.

Additionally, in the aforementioned method, the back plate may have an opening, with the diameter of the opening larger than the diameters of the holes in the vibration film plate.

Additionally, in the aforementioned method, the insulation layer may have a cutout, and forming a vibration film plate on the insulation layer may comprise forming a vibration film plate that has protrusions on its bottom surface and cutouts on its upper surface on the insulation layer.

Additionally, in the aforementioned method, the insulation layer may have a through-hole at the edge of the insulation layer going through the insulation layer, and when forming a vibration film plate on the insulation layer, a material of the vibration film plate may also fill the through-hole.

Additionally, in the aforementioned method, the diameters of the holes may be less than or equal to 18 μm.

Additionally, in the aforementioned method, the holes in the vibration film plate may be radially distributed from the center to the periphery of the vibration film plate or symmetrically distributed with respect to the center of the vibration film plate, and have a pattern of a concentric ring or a matrix, and the number of holes may be in a range of 1 to 500.

BRIEF DESCRIPTION OF THE DRAWINGS

The accompanying drawings, which are incorporated herein and constitute a part of the specification, illustrate different embodiments of the inventive concept and, together with the detailed description, serve to describe more clearly the inventive concept.

DETAILED DESCRIPTION OF THE EMBODIMENTS

Figure 1A:
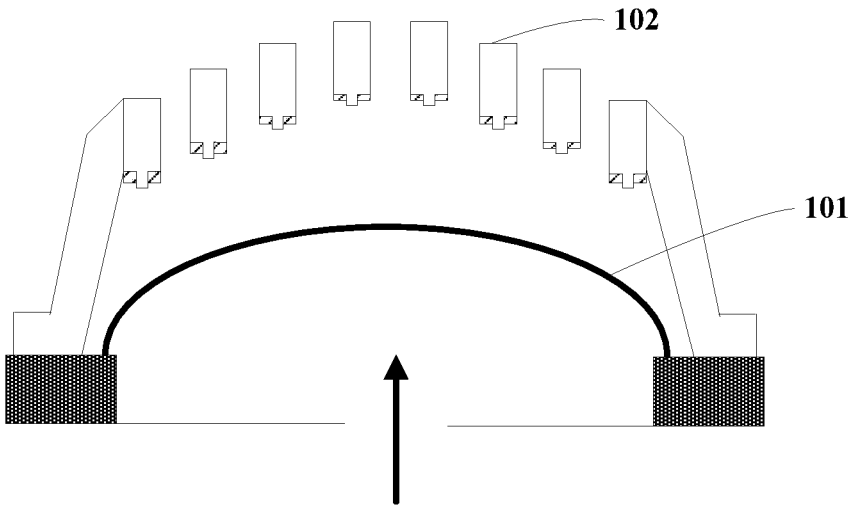
FIG. 1A shows a diagram illustrating a conventional Air Pressure Test (APT).

Example embodiments of the inventive concept are described with reference to the accompanying drawings. As those skilled in the art would realize, the described embodiments may be modified in various ways without departing from the spirit or scope of the inventive concept. Embodiments may be practiced without some or all of these specified details. Well known process steps and/or structures may not be described in detail, in the interest of clarity.

The drawings and descriptions are illustrative and not restrictive. Like reference numerals may designate like (e.g., analogous or identical) elements in the specification. To the extent possible, any repetitive description will be minimized.

Relative sizes and thicknesses of elements shown in the drawings are chosen to facilitate description and understanding, without limiting the inventive concept. In the drawings, the thicknesses of some layers, films, panels, regions, etc., may be exaggerated for clarity.

Embodiments in the figures may represent idealized illustrations. Variations from the shapes illustrated may be possible, for example due to manufacturing techniques and/or tolerances. Thus, the example embodiments shall not be construed as limited to the shapes or regions illustrated herein but are to include deviations in the shapes. For example, an etched region illustrated as a rectangle may have rounded or curved features. The shapes and regions illustrated in the figures are illustrative and shall not limit the scope of the embodiments.

Although the terms "first," "second," etc. may be used herein to describe various elements, these elements shall not be limited by these terms. These terms may be used to distinguish one element from another element. Thus, a first element discussed below may be termed a second element without departing from the teachings of the present inventive concept. The description of an element as a "first" element may not require or imply the presence of a second element or other elements. The terms "first," "second," etc. may also be used herein to differentiate different categories or sets of elements. For conciseness, the terms "first," "second," etc. may represent "first-category (or first-set)," "second-category (or second-set)," etc., respectively.

If a first element (such as a layer, film, region, or substrate) is referred to as being "on," "neighboring," "connected to," or "coupled with" a second element, then the first element can be directly on, directly neighboring, directly connected to or directly coupled with the second element, or an intervening element may also be present between the first element and the second element. If a first element is referred to as being "directly on," "directly neighboring," "directly connected to," or "directly coupled with" a second element, then no intended intervening element (except environmental elements such as air) may also be present between the first element and the second element.

Spatially relative terms, such as "beneath," "below," "lower," "above," "upper," and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientation), and the spatially relative descriptors used herein shall be interpreted accordingly.

The terminology used herein is for the purpose of describing particular embodiments and is not intended to limit the inventive concept. As used herein, singular forms, "a," "an," and "the" may indicate plural forms as well, unless the context clearly indicates otherwise. The terms "includes" and/or "including," when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as what is commonly understood by one of ordinary skill in the art related to this field. Terms, such as those defined in commonly used dictionaries, shall be interpreted as having meanings that are consistent with their meanings in the context of the relevant art and shall not be interpreted in an idealized or overly formal sense unless expressly so defined herein.

The term "connect" may mean "electrically connect." The term "insulate" may mean "electrically insulate."

Unless explicitly described to the contrary, the word "comprise" and variations such as "comprises," "comprising," "include," or "including" may imply the inclusion of stated elements but not the exclusion of other elements.

Various embodiments, including methods and techniques, are described in this disclosure. Embodiments of the inventive concept may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the inventive concept may also cover apparatuses for practicing embodiments of the inventive concept. Such apparatus may include circuits, dedicated and/or programmable, to carry out operations pertaining to embodiments of the inventive concept. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the inventive concept.

Figure 1B:
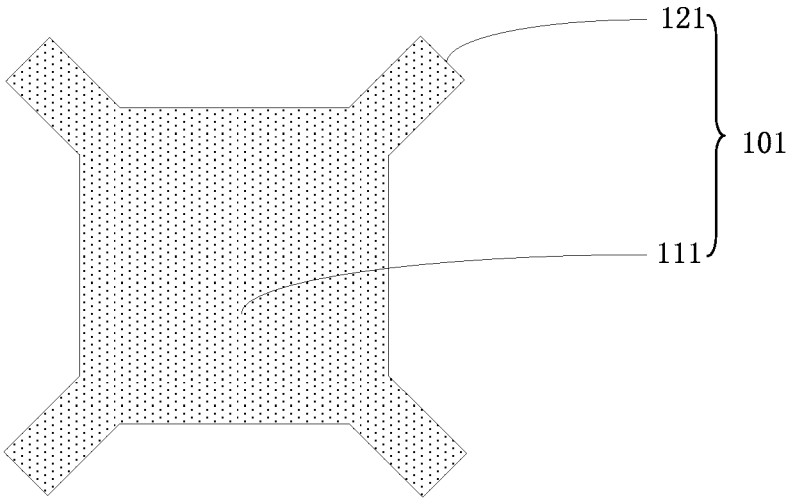
FIG. 1B shows a diagram illustrating a conventional vibration film plate.

FIG. 1A shows a diagram illustrating a conventional Air Pressure Test (APT). The microphone shown in FIG. 1A comprises a vibration film plate 101 and a back plate 102. As indicated by the arrow in FIG. 1A, incoming air from an opening at the bottom the microphone may apply a pressure on the vibration film plate 101. Referring to FIG. 1B, the vibration film plate 101 comprises a vibration component 111 and a fixture component 121. The conventional vibration film plate shown in FIG. 1B is susceptible to damage under high air pressure, which results in a low acoustic tolerance in APT and a limited service life for a microphone with such a vibration film plate.

Figure 2A:
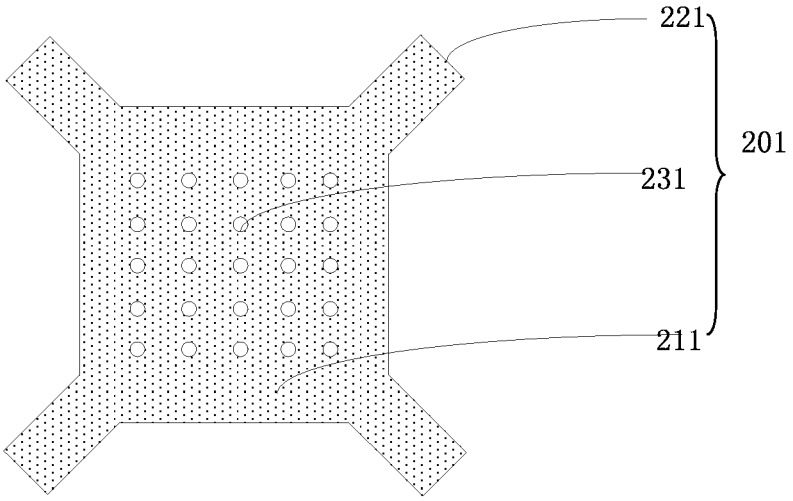
FIG. 2A shows a diagram illustrating a vibration film plate in accordance with one or more embodiments of this inventive concept.
Figure 2B:
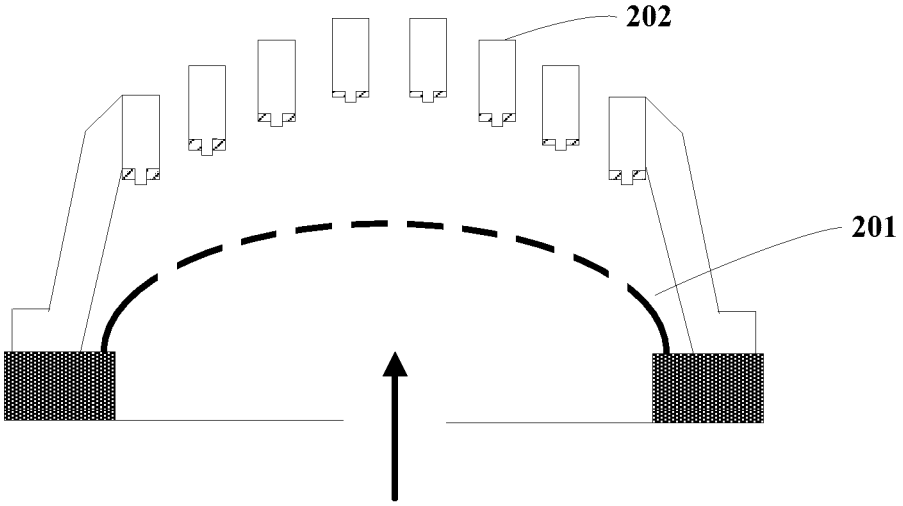
FIG. 2B shows a diagram illustrating a vibration film plate in accordance with one or more embodiments of this inventive concept undergoing an APT.

FIG. 2A shows a diagram illustrating a vibration film plate in accordance with one or more embodiments of this inventive concept. Referring to FIG. 2A, other than a fixture component 221 and a vibration component 211, the vibration film plate 201 further comprises one or more holes 231 going through the vibration film plate 201, the holes 231 provide a ventilation route for pressured air. In one embodiment, the vibration film plate 201 is a polycrystalline silicon film. The holes 231 allows a portion of air, driven by air pressure, to go through the vibration film plate 201, and thus improves the acoustic tolerance of the microphone in APT and prolongs a service life of a microphone with such a vibration film plate.

Figure 3A:
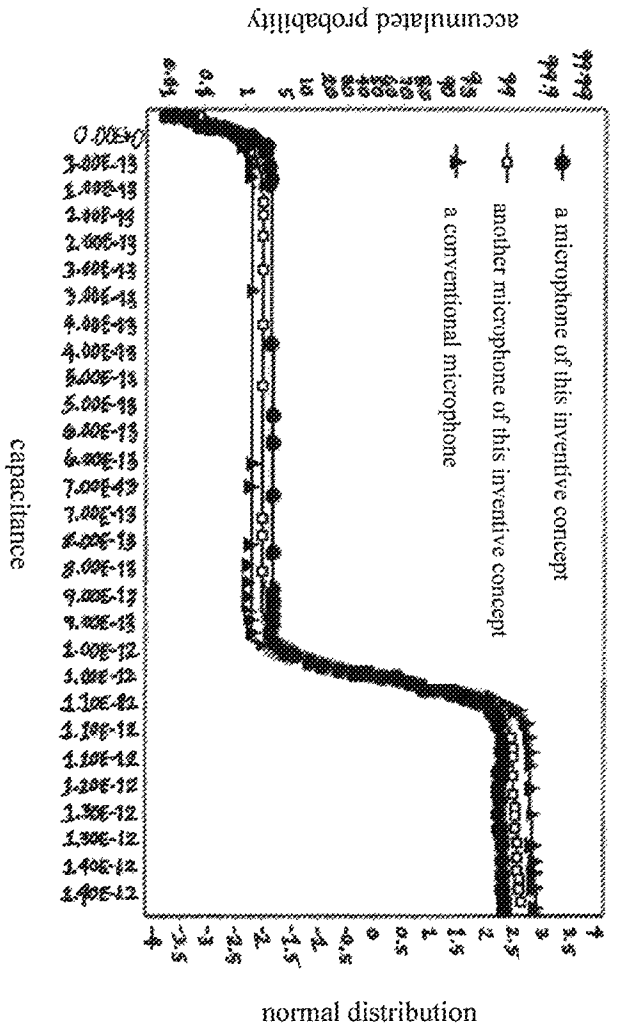
FIGS. 3A and 3B shows the results of capacitance tests on three vibration film plates, a conventional one and two in accordance with embodiments of this inventive concept.
Figure 3B:
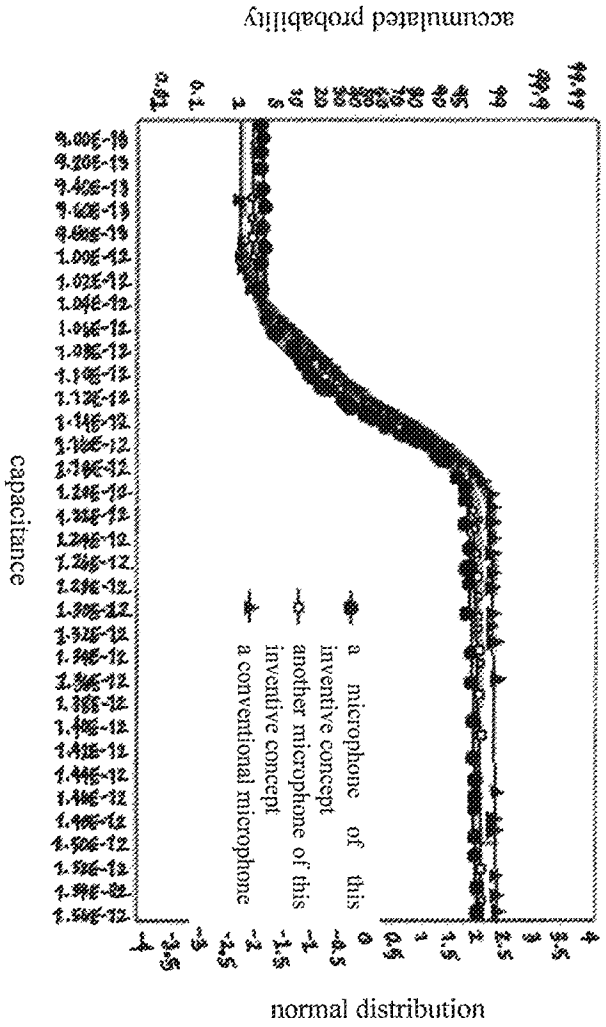

FIGS. 3A and 3B show the results of capacitance tests on three vibration film plates, a conventional one and two in accordance with embodiments of this inventive concept. In these drawings, triangle marks represent the test results on a conventional solid vibration film plate, and circular and square marks each represent the test results on a vibration film plates in accordance with one embodiment of this inventive concept. The left vertical axis in these drawings represents an accumulative probability, and the right vertical axis represents a normal distribution status. In FIG. 3A, different capacitors are tested under a 0V voltage, and the distribution of the capacitance has a tolerance lower limit of $1.0\times10^{-13}$ F, a tolerance upper limit of $1.30\times10^{-12}$ F, and a mean of $9.89-10^{-13}$ F. In FIG. 3B, different capacitors are tested under a 15V voltage, and the distribution of the capacitance has a tolerance lower limit of $9.50-10^{-13}$ F, a tolerance upper limit of $1.50\times10^{-12}$ F, and a mean of $1.11\times10^{-12}$ F. These results show that the holes in the vibration film plate do not substantially affect capacitance distribution, and therefore do not affect the normal usage of a microphone.

In one embodiment, to ensure proper operation of a microphone that has an opening in the back plate, the total area of the holes in the vibration film plate is not greater than the area of the opening in the back plate. In one embodiment, the diameters of the holes in the vibration film plate are not greater than the diameter of the opening in the back plate, this design prevents too much air from ventilating through the holes and ensures proper operation of the vibration film plate. In one embodiment, the diameters of the holes may be in a range of 0-18 μm, and, in some embodiments, may be 12 μm. The diameters of the holes may be determined based on the requirements to the acoustic tolerance and the sensitivity of the microphone. For example, a large diameter results in a high acoustic tolerance and a low sensitivity of the microphone, while a small diameter results in a low acoustic tolerance and a high sensitivity of the microphone.

In one embodiment, the holes in the vibration film plate are radially distributed from the center to the periphery of the vibration film plate, this distribution allows enough air ventilation at the center of the vibration film plate, where the vibration film plate is most susceptible to damage, to ensure its integrity.

In one embodiment, the holes in the vibration film plate are symmetrically distributed with respect to the center of the vibration film plate to ensure a balanced force distribution on different parts of the vibration film plate during normal usage or during an APT, thus increasing the acoustic tolerances and prolonging the service life of a microphone.

In one embodiment, the holes in the vibration film plate have a pattern of a concentric ring or a matrix. For example, when the vibration film plate has a square shape as shown in FIG. 2A, the holes in the vibration film plate may have a matrix pattern including rows and columns; when the vibration film plate has a circular shape, the holes in the vibration film plate may have a concentric ring pattern. The distribution of the holes is adapted to the shape of the vibration film plate and the position of its fixture component to ensure balanced force on the vibration film plate during air ventilation. This design further increases the acoustic tolerances and prolongs the service life of a microphone.

In one embodiment, the number of holes may be in a range of 1 to 500, with the exact number being determined based on the requirement to the acoustic tolerance and the sensitivity of a microphone. A large number of holes results in a high acoustic tolerance and a low sensitivity of the microphone, while a small number of holes results in a low acoustic tolerance and a high sensitivity of the microphone. In one embodiment, the holes in the vibration film plate may be distributed following a 9×9 matrix pattern.

Figure 4:
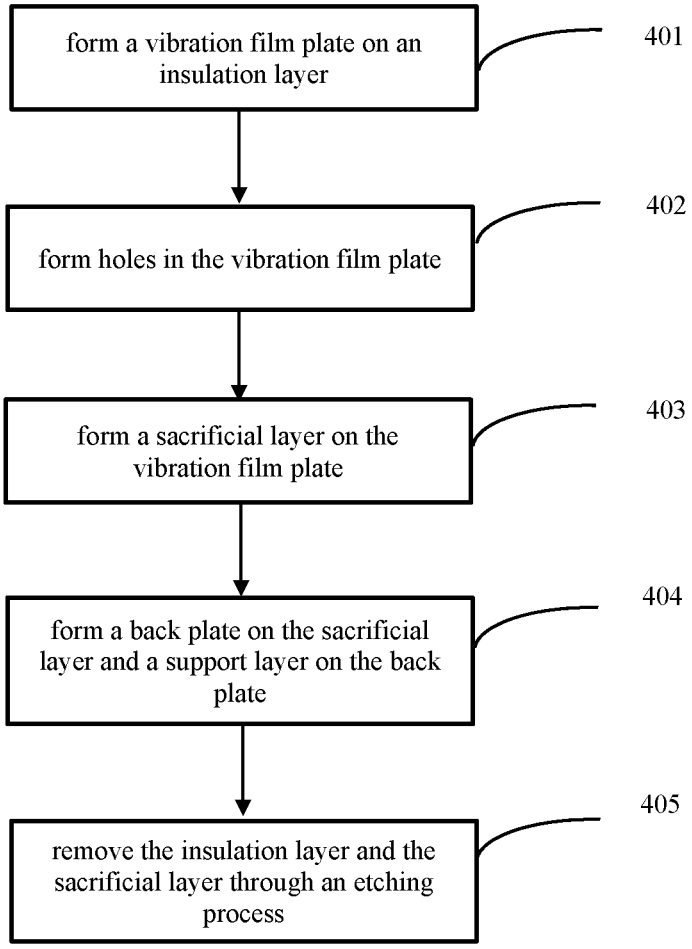
FIG. 4 shows a flowchart illustrating a microphone manufacturing method in accordance with one or more embodiments of this inventive concept.

FIG. 4 shows a flowchart illustrating a microphone manufacturing method in accordance with one or more embodiments of this inventive concept.

In step 401, a vibration film plate is formed on an insulation layer. In one embodiment, the insulation layer may be made of a silicon-based oxide and be formed on a substrate that is made of silicon.

In step 402, a plurality of holes going through the vibration film plate is formed in the vibration film plate.

In step 403, a sacrificial layer is formed on the vibration film plate, the sacrificial layer may be made of a silicon-based oxide.

In step 404, a back plate is formed on the sacrificial layer, and a support layer is formed on the back plate. In one embodiment, the back plate and the support layer on the back plate may have an opening in them, through which external air may apply a pressure on the vibration film plate.

In step 405, the insulation layer and the sacrificial layer are removed through an etching process. In one embodiment, an opening may be first made in the substrate, and the etching on the insulation layer and the sacrificial layer may be conducted by injecting hydrofluoric acid through this opening.

Through the steps described above, a vibration film plate comprising a plurality of holes is formed. The holes in the vibration film plate provide a ventilation route for pressured air inside, and thus reduce the pressure on the vibration film plate, it prevents the vibration film plate from rupture and increases the acoustic tolerance of the microphone.

Figure 5:
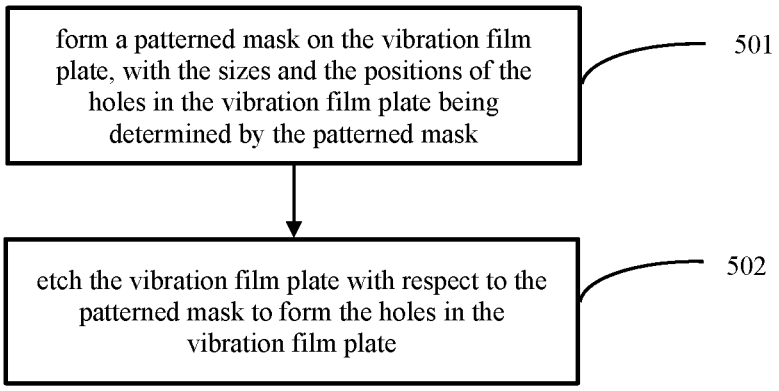
FIG. 5 shows a flowchart illustrating a manufacturing method of a vibration film plate comprising a plurality of holes in accordance with one or more embodiments of this inventive concept.

FIG. 5 shows a flowchart illustrating a manufacturing method of a vibration film plate comprising a plurality of holes in accordance with one or more embodiments of this inventive concept.

In step 501, a patterned mask, such as a patterned photoresist, is formed on the vibration film plate, with the sizes and the positions of the holes in the vibration film plate being determined by the patterned mask. In one embodiment, several through-holes with predetermined sizes may be made on predetermined positions in the patterned mask, these through-holes may be symmetrically distributed with respect to the center of the vibration film plate and may have a pattern of a concentric ring or a matrix. For example, the patterned masked may be formed by exposing and developing under another mask with through-holes at corresponding positions.

In step 502, the vibration film plate is etched with respect to the patterned mask, so that a plurality of holes is formed in the vibration film plate.

In the manufacturing method described above, the holes in the vibration film plate may be formed by modifying existing masks, therefore this method does not increase the number of masks and therefore has little effect on the overall complexity of the process, and can be easily integrated into existing manufacturing processes.

FIGS. 6A, 6B, 6C, 6D, 6E, and 6F show schematic sectional views illustrating different stages of a microphone manufacturing method in accordance with one or more embodiments of this inventive concept.

Figure 6A:
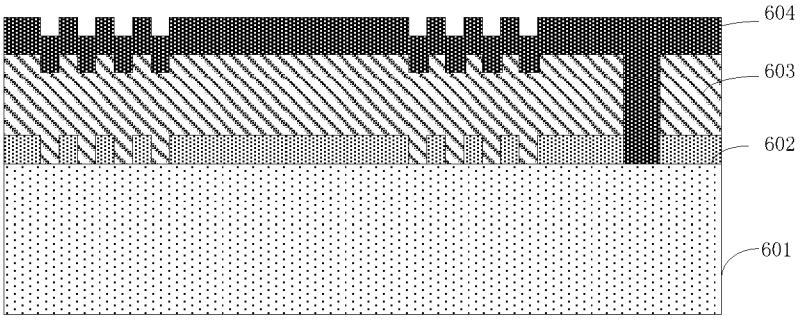
FIGS. 6A, 6B, 6C, 6D, 6E, and 6F show schematic sectional views illustrating different stages of a microphone manufacturing method in accordance with one or more embodiments of this inventive concept.

FIG. 6A shows a substrate 601, a first insulation layer 602, a second insulation layer 603, and a vibration film plate 604. In one embodiment, the vibration film plate 604 may comprise protrusions or cutouts (holes that extend into a layer) to prevent it from adhering with a back plate. In one embodiment, the cutouts in the vibration film plate 604 may be formed by first forming cutouts in the first insulation layer 602. In one embodiment, a through-hole going through the first insulation layer 602 and the second insulation layer 603 may be formed, and when forming the vibration film plate 604, the material of the vibration film plate 604 (e.g., polycrystalline silicon) may also fill the through-hole in the first insulation layer 602 and the second insulation layer 603 to ensure sufficient support of the vibration film plate 604 on the substrate 601.

Figure 6B:
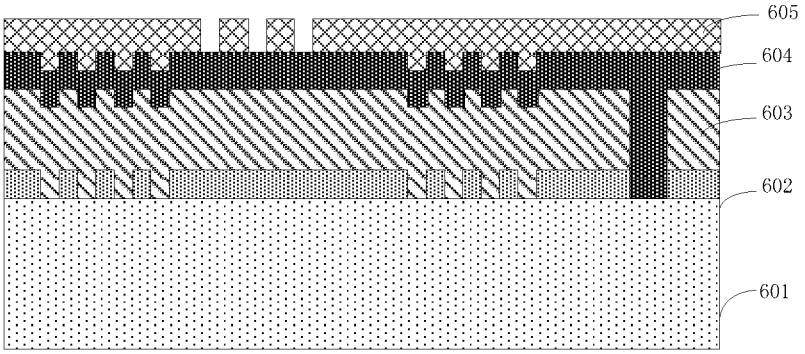

Referring to FIG. 6B, a patterned mask 605 is formed on the vibration film plate 604, with the patterned mask 605 comprising a plurality of through-holes.

Figure 6C:
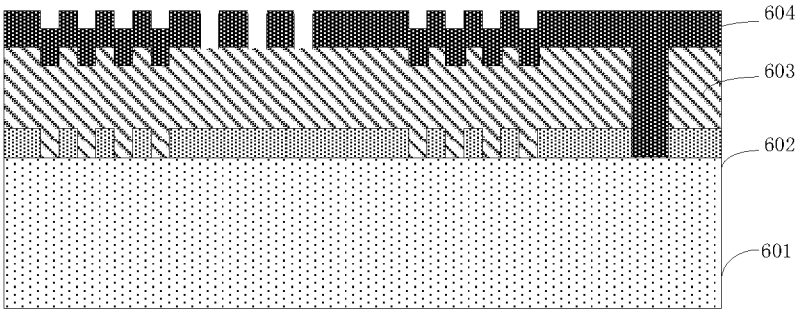

Referring to FIG. 6C, a plurality of holes going through the vibration film plate 604 is formed in the vibration film plate 604 by etching the vibration film plate 604 with respect to the patterned mask 605.

Figure 6D:
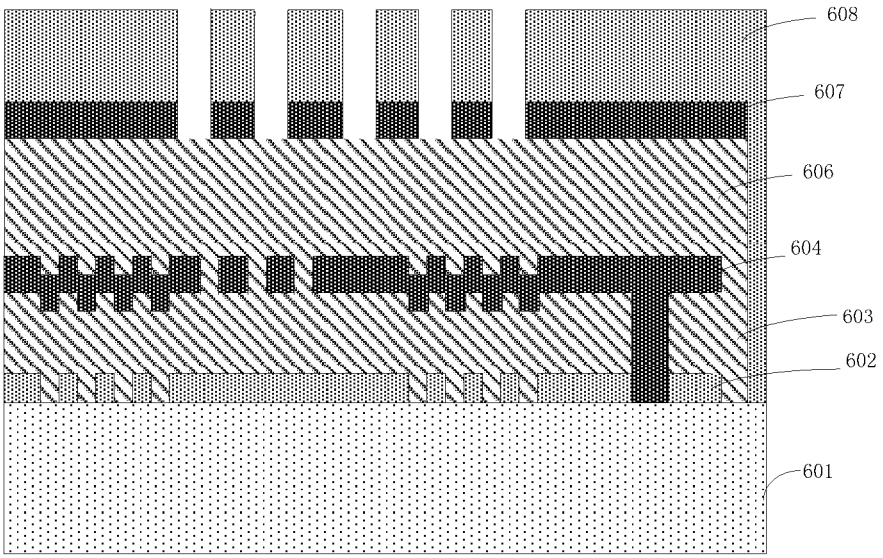

Referring to FIG. 6D, a sacrificial layer 606 comprising a silicon-based oxide, a back plate 607 comprising polycrystalline silicon, and a support layer 608 comprising silicon nitride are respectively formed on the vibration film plate 604. In one embodiment, the back plate 607 and the support layer 608 may have an opening to allow external air to flow through. The diameters of the opening are larger than the diameters of the holes in the vibration film plate 604.

Figure 6E:
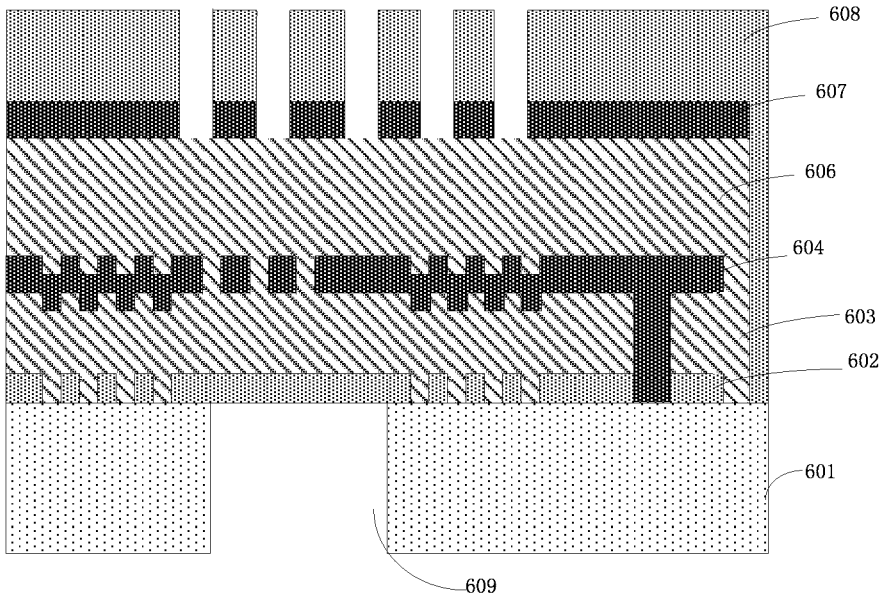

Referring to FIG. 6E, an opening 609 is formed at the bottom of the substrate 601.

Figure 6F:
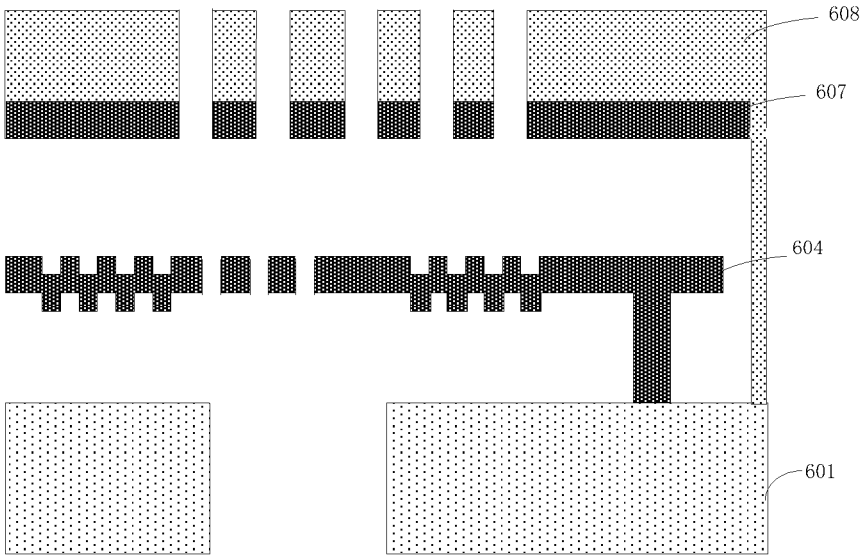

Referring to FIG. 6F, the first insulation layer 602, the second insulation layer 603, and the sacrificial layer 606 are removed by injecting hydrofluoric acid through the opening 609 to form a basic capacitor structure of the microphone. In one embodiment, if there is no through-hole in the first insulation layer 602 and the second insulation layer 603, an edge portion of the first insulation layer 602 and the second insulation layer 603 may be retained by, for example, properly-controlled etching time, to ensure proper connection between the vibration film plate 604 and the substrate 601.

The vibration film plate manufactured by this method has a plurality of holes going through it, these holes provide a ventilation route for pressured air, and thus reduce the pressure on the vibration film plate, they prevent the vibration film plate from rupture and increase the acoustic tolerance of the microphone.

This concludes the description of a semiconductor device and its manufacturing method in accordance with one or more embodiments of this inventive concept. For purposes of conciseness and convenience, some components or procedures that are well known to one of ordinary skills in the art in this field are omitted. These omissions, however, do not prevent one of ordinary skill in the art in this field to make and use the inventive concept herein disclosed.

While this inventive concept has been described in terms of several embodiments, there are alterations, permutations, and equivalents, which fall within the scope of this disclosure. It shall also be noted that there are alternative ways of implementing the methods and/or apparatuses of the inventive concept. Furthermore, embodiments may find utility in other applications. It is therefore intended that the claims be interpreted as including all such alterations, permutations, and equivalents. The abstract section is provided herein for convenience and, due to word count limitation, is accordingly written for reading convenience and shall not be employed to limit the scope of the claims.

What is claimed is:

1. A microphone, comprising:

a substrate comprising an opening;

a back plate overlapping the substrate and comprises a through hole; and a vibration film plate positioned between the substrate and the back plate and comprising holes, wherein the holes include a first hole and a hole set, wherein the first hole corresponds to each of the through hole and the opening, and wherein the hole set surrounds the first hole.

2. The microphone of claim 1, wherein the diameters of the holes are less than or equal to 18 μm.

3. The microphone of claim 1, wherein the holes in the vibration film plate are radially distributed from the center to the periphery of the vibration film plate.

4. The microphone of claim 3, wherein the holes in the vibration film plate have a pattern of a concentric ring or a matrix.

5. The microphone of claim 4, wherein the number of holes is in a range of 1 to 500.

6. The microphone of claim 1, wherein the holes in the vibration film plate are symmetrically distributed with respect to the center of the vibration film plate.

7. The microphone of claim 1, wherein the substrate is a silicon substrate, and wherein the opening extends through the silicon substrate.

8. The microphone of claim 1, wherein a minimum vertical distance from the first hole to the substrate is greater than a minimum vertical distance from the hole set to the substrate.

9. The microphone of claim 1, wherein the vibration film plate is a polycrystalline silicon film.

10. A microphone manufacturing method, comprising:

forming an insulation layer;

forming a vibration film plate on the insulation layer after the insulation layer has been formed, wherein the insulation layer has cavities that are spaced from the vibration film plate;

forming a plurality of holes in the vibration film plate;

forming a sacrificial layer on the vibration film plate;

forming a back plate on the sacrificial layer;

forming a support layer on the back plate; and removing the insulation layer and the sacrificial layer through an etching process.

11. The method of claim 10, wherein forming a plurality of holes in the vibration film plate comprises:

forming a patterned mask on the vibration film plate, with the sizes and the locations of the plurality of holes being determined by the patterned mask; and conducting an etching process on the vibration film plate with respect to the patterned mask to form the plurality of holes.

12. The method of claim 10, wherein the back plate has an opening, with the diameter of the opening larger than the diameters of the holes in the vibration film plate.

13. The method of claim 10, wherein the vibration film plate has protrusions on its bottom surface and cutouts on its upper surface, wherein the protrusions respectively correspond to the cavities of the insulation layer, and wherein the cutouts respectively correspond to the cavities of the insulation layer.

14. The method of claim 10, wherein the insulation layer has a through-hole positioned at an edge of the insulation layer and going through the insulation layer, and wherein a portion of the vibration film plate fills the through-hole and is spaced from the cavities.

15. The method of claim 10, wherein the diameters of the holes are less than or equal to 18 μm.

16. The method of claim 10, wherein the holes in the vibration film plate are radially distributed from the center to the periphery of the vibration film plate.

17. The method of claim 10, wherein the holes in the vibration film plate are symmetrically distributed with respect to the center of the vibration film plate.

18. The method of claim 10, wherein the holes in the vibration film plate have a pattern of a concentric ring or a matrix.

19. The method of claim 10, wherein the number of holes is in a range of 1 to 500.

20. The microphone of claim 1, wherein the vibration film plate further comprises a first plurality of recesses and a second plurality of recesses, and wherein the holes are through holes and are positioned between the first plurality of recesses and the second plurality of recesses.

* * * * *